US009803599B2

(12) United States Patent
Sula

(10) Patent No.: US 9,803,599 B2
(45) Date of Patent: Oct. 31, 2017

(54) SYSTEM FOR AIR SUPPLY TO ENGINE OF A MOTOR BOAT

(71) Applicant: Martin Sula, Brno (CZ)

(72) Inventor: Martin Sula, Brno (CZ)

( * ) Notice: Subject to any disclaimer, the term of this patent is extended or adjusted under 35 U.S.C. 154(b) by 0 days.

(21) Appl. No.: 15/303,422

(22) PCT Filed: Feb. 26, 2016

(86) PCT No.: PCT/CZ2016/000023
§ 371 (c)(1),
(2) Date: Oct. 11, 2016

(87) PCT Pub. No.: WO2016/134682
PCT Pub. Date: Sep. 1, 2016

(65) Prior Publication Data

US 2017/0030309 A1 Feb. 2, 2017

(30) Foreign Application Priority Data

Feb. 27, 2015 (CS) ..... 2015-146

(51) Int. Cl.
*F02M 35/16* (2006.01)
*B63B 35/79* (2006.01)
(Continued)

(52) U.S. Cl.
CPC ..... *F02M 35/165* (2013.01); *B63B 35/7943* (2013.01); *B63H 11/01* (2013.01);
(Continued)

(58) Field of Classification Search
CPC .. F02M 35/165; F02M 35/167; F02M 35/168; B63B 35/7943; B63B 35/731
See application file for complete search history.

(56) References Cited

U.S. PATENT DOCUMENTS 1,945,435 A * 1/1934 Hopkins ..... B63B 35/7943 440/87
4,971,586 A 11/1990 Walsh
(Continued)

FOREIGN PATENT DOCUMENTS

FR 1 442 326 A 6/1966
GB 2 090 213 A 7/1982

OTHER PUBLICATIONS

International Search Report issued in International Appln. No. PCT/CZ2016/000023, dated Jul. 11, 2016.
(Continued)

*Primary Examiner* — Andrew Polay
(74) *Attorney, Agent, or Firm* — Charles C. Achkar; Ostrolenk Faber LLP

(57) ABSTRACT

The present invention is a system for air supply to the engine of a motor float comprising a bottom part and an upper part of the body defining the inner space of the float, in which a combustion engine is arranged, wherein the upper part of the body is in its front part provided with an air supply, characterized in that the combustion engine is arranged in the engine compartment and separated from the rest of the inner space of the float by means of a partition provided with a suction opening in its front part, wherein to provide the circulation of air in the inner space of the float a sealing rib extends from the front part of the partition towards the tip of the float, separating the air supply and suction opening from one another, wherein at least one rear pump for sucking the leaking water is arranged in the rear part of the inner space of the float. The main object of the invention is thus to use the interspace of the float to provide separation of water and air, when eventual separated water may be sucked away by a pump operating on any principle (electric, vacuum, etc.).

7 Claims, 6 Drawing Sheets

(51) Int. Cl.

| | |
|---|---|
| ***F02B 61/04*** | (2006.01) |
| ***B63H 11/01*** | (2006.01) |
| ***B63H 11/04*** | (2006.01) |
| ***B63H 21/14*** | (2006.01) |
| ***F02B 75/02*** | (2006.01) |
| ***F02M 35/10*** | (2006.01) |

(52) U.S. Cl.
CPC ..... *B63H 11/04* (2013.01); *B63H 21/14* (2013.01); *F02B 61/045* (2013.01); *F02B 75/02* (2013.01); *F02M 35/10242* (2013.01); *F02M 35/168* (2013.01); *B63B 2758/00* (2013.01); *B63B 2770/00* (2013.01); *F02B 2075/025* (2013.01)

(56) References Cited

U.S. PATENT DOCUMENTS

| | | | | |
|---|---|---|---|---|
| 6,112,685 | A * | 9/2000 | Matsuda | B63B 19/12 114/55.5 |
| 6,544,084 | B1 * | 4/2003 | Nanami | B63B 35/731 114/55.51 |
| 2002/0121231 | A1 * | 9/2002 | Hattori | B63B 35/731 114/55.53 |
| 2005/0239352 | A1 | 10/2005 | Montgomery | |

OTHER PUBLICATIONS

Written Opinion of the ISR issued in International Appln. No. PCT/CZ2016/000023, dated Jul. 11, 2016.

* cited by examiner

SYSTEM FOR AIR SUPPLY TO ENGINE OF A MOTOR BOAT

CROSS REFERENCE TO RELATED APPLICATIONS

The present application is a §371 National Phase application based on PCT/CZ2016/000023 filed Feb. 26, 2016 which claims the benefit of Czech Republic Application No. PV 2015-146, filed Feb. 27, 2015 the subject matter of each of which is incorporated by reference in their entirety.

FIELD OF THE INVENTION

The invention relates to a solution of air intake for a motor float restricting the leakage of water into the engine space, more particularly to a system for air supply to the engine of a motor float.

BACKGROUND OF THE INVENTION

Motor float is intended for one's ride over water surface, generally in a vertical position of the rider. Thanks to the movement speed, easy manipulation and resistance it allows riding over calm surface as well as in big waves, which are impassable for large and heavy motor floats. On a calm surface rotations with radius up to 4 m in the approach speeds of about 40 km/h are allowed. The float can react quickly when riding on a wave and therefore reach the right place, or easily and safely leave the wave.

Motor float is driven by a combustion engine arranged inside the float. The engine needs sufficient fresh air supply to function properly. Air is sucked into the engine through a carburator, in which it is mixed with fuel in the pre-set ratio. In case of insufficient air supply the engine the performance rapidly decreases and may lead to a complete stopping of engine. During normal driving water pours over the float surface, especially in turns, and the float may sink under the surface even for several seconds. Moreover, when the motor float moves along the water surface with great speed and due to maneouvres, it is exposed to the streaking water, surrounding waves, and in some cases it may turn over under the water surface. Water leaking into the engine section and being sucked by the engine may result into the engine being damaged. Further requirement for proper function of the engine is sufficient air supply inside the engine compartment for the cases when the float is sinked under the water surface for a brief moment.

The present solutions are based on the use of a suction pump or a reverse valve. The U.S. Pat. No. 7,001,232 describes a solution which uses the reverse valve at the suction inlet into the float section and curvature of the suction pipe. The solution is designed for a robust float of great load displacement and low maneuverability. However, it is not suitable for using with light float enabling large angles in turns, jumps, and ride in waves with great speed, because during a more dynamic ride it will not prevent larger leakage of water into the engine compartment. The solutions of water suction from the engine compartment are described in the U.S. Pat. No. 5,582,529 as well as in the U.S. Pat. Nos. 6,192,817 and 6,568,340. These solutions aim to prevent water leakage into the inner space of the float while being tilted. Solution from the U.S. Pat. No. 5,582,529 describes water suction using a pump arranged in the float chamber in front of the engine. However, this pump only functions when the float is in horizontal or slightly tilted position. In case of a greater angle or greater amount of water the space for water suction is overflowed and water reaches the engine. In the solution of the U.S. Pat. No. 6,568,340 is the suction arranged directly on the float, where it is constantly overflowed, which rapidly decreases the volume in the present water separator and thus also the ability to supply sufficient amount of air necessary for the engine performance. Even in this case the problem of tilted float is not solved. Another drawback of this solution is the use of a long pipe for underpressure suction, thanks to which the applicable underpressure as well as the volume of sucked water decreases. The solution of the U.S. Pat. No. 6,192,817 uses the same water separator with added pipe for air supply directly into the engine. Of course, this pipe causes pulses and undesirable resonant pressure waves, which rapidly decrease the performance and stable operation of the engine. There is also a problem of pressure losses resulting from friction between sucked air and pipe walls.

SUMMARY OF THE INVENTION

Object of the present invention is to create a system of structural measures, which will prevent water from entering the engine compartment and subsequently the engine during suction of air. The said object is met by a system for air supply into the engine of a motor float comprising a bottom part and an upper part of the body defining the inner space of the float, in which a combustion engine is arranged, wherein the upper part of the body is in the front section provided with an air supply, characterized in that the combustion engine is arranged in the engine compartment separated from the rest of the inner space of the float by means of a partition provided in the front part with a suction opening, wherein to secure the air circulation in the inner space of the float a sealing rib extends from the front part of the partition towards the tip of the float separating the air supply and suction opening, wherein in the rear part of the inner space of the float at least one back pump for sucking out the leaked water is arranged. The main idea of the invention is thus using the interspace of the float for providing the separation of water and air, when eventual separated water may be sucked off by a pump functioning on any principle (electrical, vacuum, etc.).

The material of the float and the partition is preferably carbon fibre reinforced composite CFRP. Another suitable materials are glass fiber reinforced composite, hybrid fabrics of kevlar/carbon, glass/kevlar, however, these increase the weight and reduce the strength of the whole structure.

The partition, which connects the bottom part and the upper part of the body defines the engine compartment, preferably it has a shaped profile so as not to break when the float's body exerts pressure during driving on water surface. The partition may at the same time perform the function of suspension, i.e. to ensure the distribution of pressure of the carbon web. The suction opening in the front part of the partition is preferably arranged above the level of the bottom body, more preferably at the upper part of the body.

Thanks to the partition, labyrinth air passage is provided in the inner space. Undesirable water, which enters the inner space of the float together with air during operation, is sucked out by the rear pump outside the inner space of the float. The rear pump for sucking the leaked water is arranged in the rear part of the inner space of the float, because this part is at the same time the lowest part of the tilted float during normal operation, which means that water entering the inner space of the float does not flow there. The rear pump preferably functions on the principle of vacuum pump, when pressure is created by positioning the outlet in the turbine area. The rear pump may function on electrical principle, however, these pumps increase the consumption of electric power and decrease the run of the float.

The engine and other components necessary for the operation of the engine, such as ignition, fuel tank, coil, wiring, suction pumps and exhaust, are arranged in the engine compartment. Further, a shaft extends from the engine compartment towards the turbine, which drives the float. Input into the engine compartment defined by the bottom part and the upper part of the body and the partition may preferably be secured by detachable cover arranged in the upper part. Shape of the engine compartment is determined by the size of the combustion engine and its equipment (ignition, fuel tank, etc.) and by the requirements on sufficient air supply for reliable operation of the engine. The compartment may be altered according to the needs of the engine performance. The engine is arranged in the longitudinal axis of the float perpendicular to the driving direction in a position, which is optimal for manipulation with the float during driving, i.e. somewhere between the centre of gravity of the driver and the centre of gravity of the float. Of course, the engine compartment allows arrangement of the engine parallely to the driving direction. It is possible to place two-stroke as well as suitably shaped four-stroke engine provided with carburetor or direct fuel injection.

In a preferred embodiment, the system for air supply to the engine of the motor float may further comprise at least one transverse or longitudinal rib serving as a barrier for leaking water arranged in the inner space of the engine compartment, which, similarly as the partition, may extend between bottom and upper part of the body or it may only extend from the bottom part of the body not reaching the upper part of the body. These ribs may prevent leakage of water and at the same time perform the action of structure reinforcement. In such case, similarly as the partitions, the ribs may preferably have a shaped profile.

The system for air supply to the engine of the motor float may preferably further comprise at least one pump for suction of water from the engine compartment. This pump may be arranged in the rear part of the engine compartment, during its normal operation in its lowest part. This provides two-step suction of leaked water from the lowest part of the whole float determined by the principle of movement of the float as well as from the lowest part of the engine compartment. This kind of system has unique properties in relation to the prevention of the water leakage, which maximizes the sufficient air supply to the engine compartment.

Preferably, two pumps will be arranged in the engine compartment at the same time, the first one being mechanical pump using underpressure generated by the engine, the second one being an electrically operated pump powered by batteries. Electric pump is launched with a certain period and evaluates the presence of water (based on resistance, etc.). In case water is present, the pump turns on and water is drained. Such solution is easier than using any kind of sensor supposed to artificially detect water in the engine. The pumps operate independently, the underpressure pump is intended primarily to drain smaller leakages and operates continually and without electricity, the electric pump serves to suck any accidental greater leakage of water, e.g. when the cover is opened, when the float is sunk for another interval, etc., and it is turned on only during detection of water to save the capacity of battery.

In a preferred embodiment it is possible to arrange elements made of floating material into the inner space of the float, inside the engine compartment or outside the engine compartment. This material may be, for example, air, foam, polystyrene, etc. By this adjustment we obtain an unsinkable float. By using floating material the stock of air necessary for operation of the engine is reduced, however, the function of water separation and thus also safe engine operation is preserved.

DESCRIPTION OF DRAWINGS

The invention will be disclosed in more detail by means of drawings, in which.

DESCRIPTION OF EXEMPLARY EMBODIMENTS

The object of invention is a system for air supply to the engine of a motor float, which will be further characterized by means of exemplary embodiments with references to the respective drawings.

Figure 2:
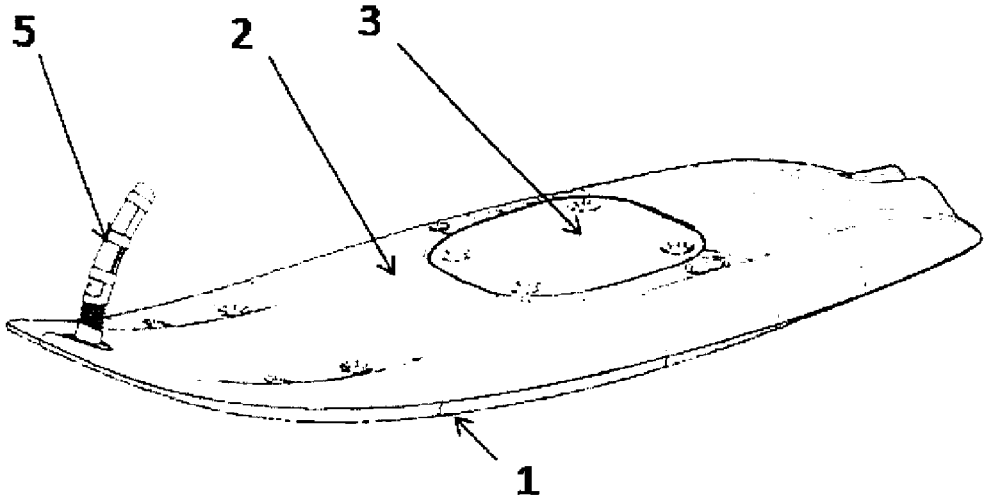
FIG. 2 shows a view on an assembled float, FIG. 3 schematically illustrates air circulation and pumps for water suction.
Figure 4:
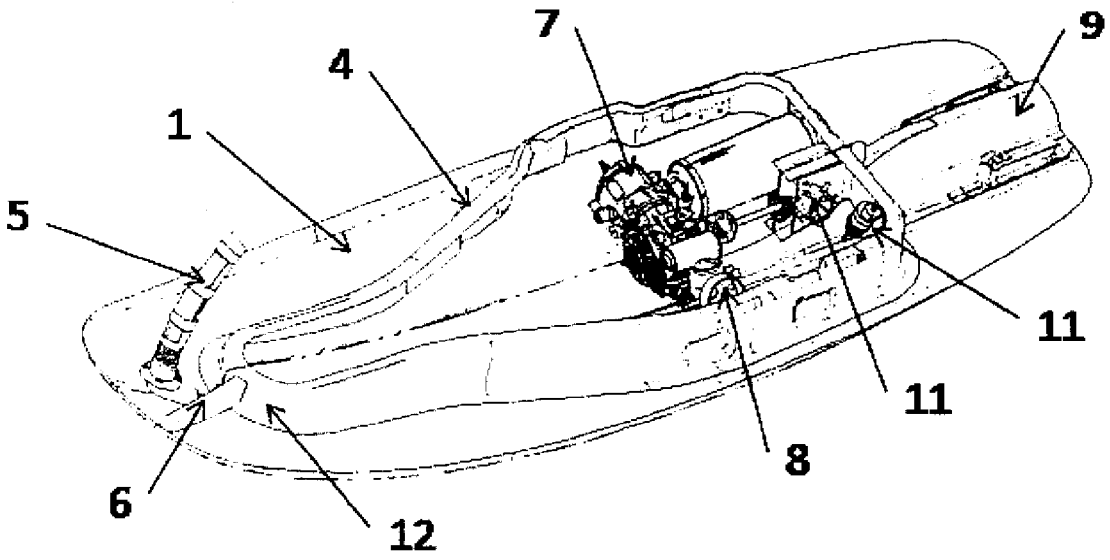
FIG. 4 illustrates the float without the upper part being shown.

The body of the motor float consists of a bottom part 1 and an upper part 2, as illustrated in the FIG. 2, between which a partition 4 defining the engine compartment is arranged, and a sealing rib 6 see FIG. 4. Input into the inner space of the motor float is secured by a cover 3. The engine 7 and other equipment necessary for operation of the engine (not shown) are arranged in the engine compartment. The shaft extends from the engine compartment towards the turbine which drives its own float.

The engine 7 in the engine compartment may be oriented longitudinally as well as transversely. Mounts for the engine 7 may be arranged on the 4 itself or on the bottom part 1 of the body. Arrangement of the mounts directly of the engine 7 directly on the partition 4 reduces vibrations of the whole system and contributes to smooth operation and reduced wear of particular components.

The supply of air into the inner space of the float is done by an air supply 5 arranged in the front section of the upper part 2 of the float body, which is made of material which is flexible as well as sufficiently strong to keep its shape in a straight position at about 20 cm above the outside upper surface of the float to eliminate majority of streaking water.

The body of motor float as well as partitions are made of carbon fibre reinforced composite. Dimensions of an exemplary float are: length 1800 mm, width 600 mm, height 150 mm. The weight of the float including fuel is 14 kg, maximum speed is 57 km/h with fuel consumption of 2 l/h.

Performance of an installed two-stroke engine ranges from about 10 to 15 hp depending on a configured exhaust and other components. The float is provided with fully automatic electronic ignition with integrated batteries allowing for 4 h of continuous driving.

Inner volume of the float is cca 80 l, thanks to the labyrinth system an engine compartment without the presence of water with volume of about 35 l is obtained. With engine's air consumption of 6 l/s, the stock of air in case of sinking under water is sufficient for 5.8 s. Ratios of particular volumes, the whole float and the engine compartment may vary depending on the purpose of the float.

Figure 3:
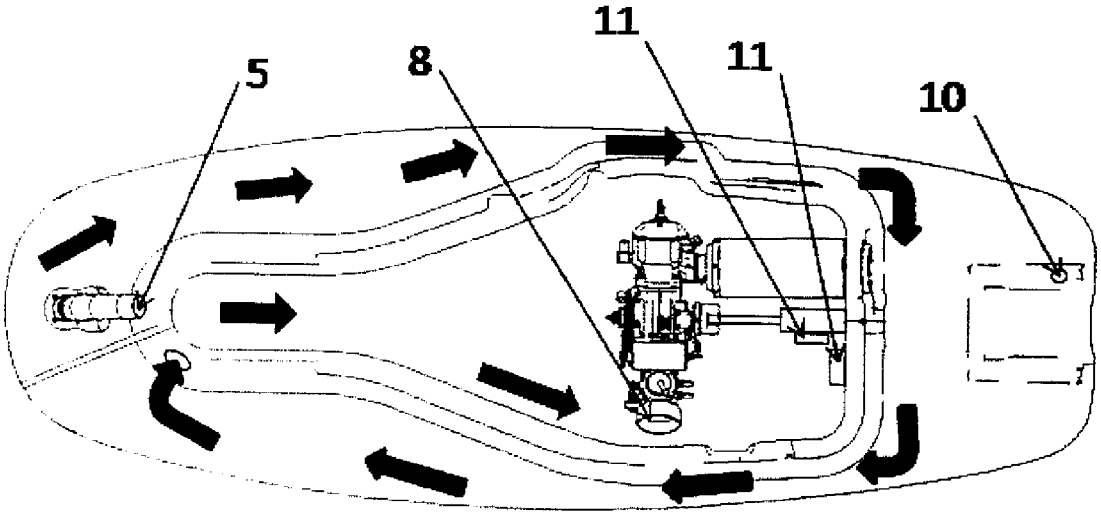

Air sucked into the inner space of the float must flow around the engine compartment into the rear section of the inner space of the float and from there it returns around the engine compartment into the front section of the inner space of the float, where the partition 4 is provided with a suction opening 12 arranged above the level of the bottom part 1 of the body, where air enters the engine compartment, as illustrated in the FIG. 3. Air is subsequently sucked away by the engine 7 into the carburator 8. Air circulation in the inner space of the float is secured by the sealing rib 6, which divides the air supply 5 and the suction opening 12.

Figure 1:
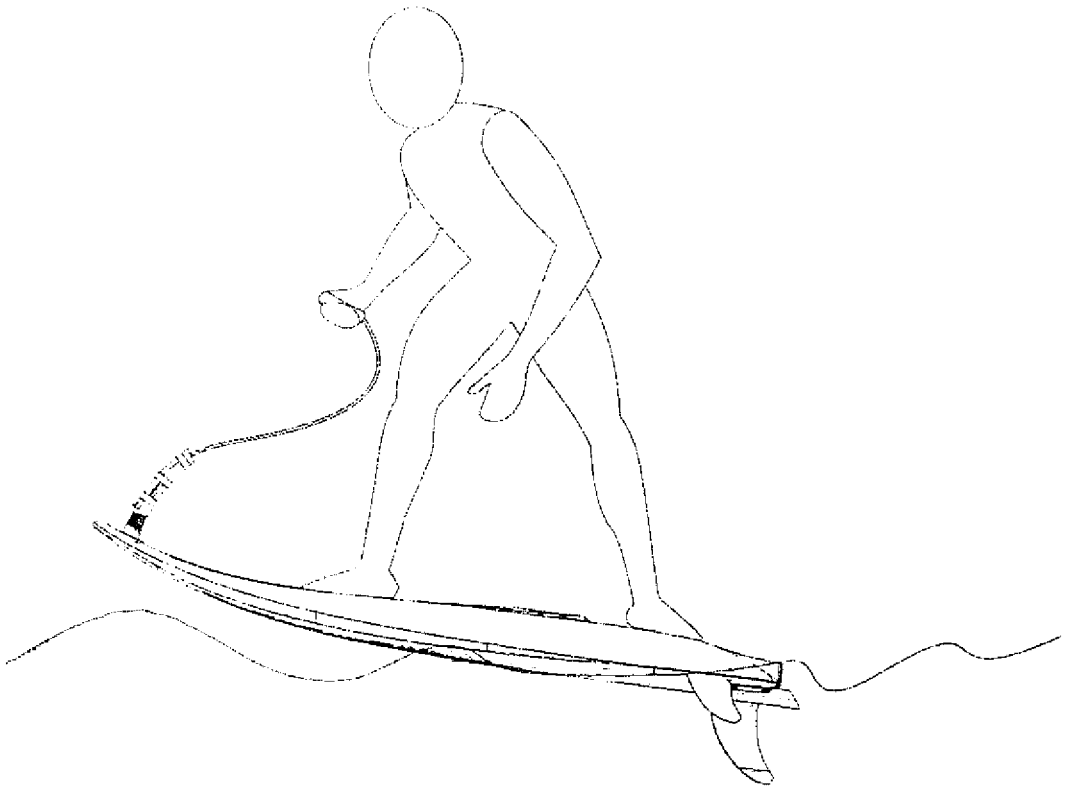
FIG. 1 shows a normal working position of the float during driving of a straight driver.

Due to reaction forces from the compulsion of the float and the position of the driver, the float is tilted during driving towards the water surface in sagittal plane, as illustrated in the FIG. 1. The tilt angle is variable depending on the speed. Thanks to the tilt, water which leaked into the inner space of the float flows into the rear part, where it is sucked by the rear pump 10 by means of underpressure from the turbine 9 outside the float. This will prevent water from leaking into the engine compartment during driving, neither in sharp turns nor jumps, as the front part is always higher than the rear part. In case the float is overturned or due to untightness, water leaks into the engine compartment, two pumps 11 are arranged therein to remove the water. The first mechanical pump uses underpressure generated by the engine, the second electric pump is controlled electronically and powered by batteries. The electric pump is controlled based on time intervals and sensing of water presence. In case water is present, the electric pump is turned on the longer time interval, in case water is not present, the electric pump remains turned off. This allows to achieve maximum energy performance of the whole suction system without reverse valves and flaps, which may lead to failure and a breakdown of the whole system.

Figure 5:
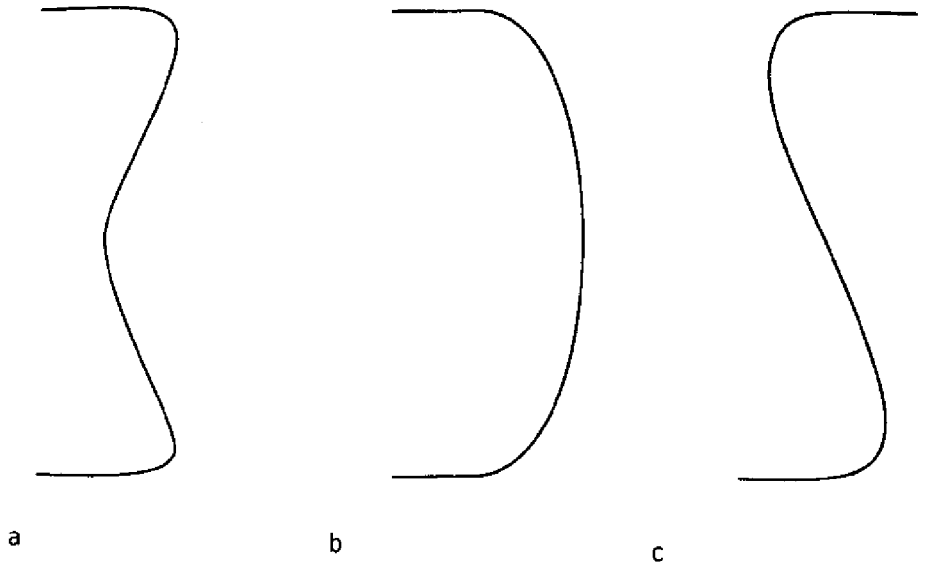
FIG. 5 illustrates an exemplary shaped profiles of the partition defining the engine compartment, FIG. 6 schematically illustrates minimal engine compartment.

The partition 4 defining the engine compartment is shaped, due to low buckling stability of composite elements, in the direction perpendicular to the direction of the fibres. The shape of the partition divides the loading force into the composite fibres and thus reduces the strain in the structure. The shaped partition at the same time serves as a suspension element, which eliminates and divides the dynamic shocks into the whole structure of the body. The most preferable profile is "S", "U", or similar round shapes, as illustrated in the FIG. 5.

Figure 6:
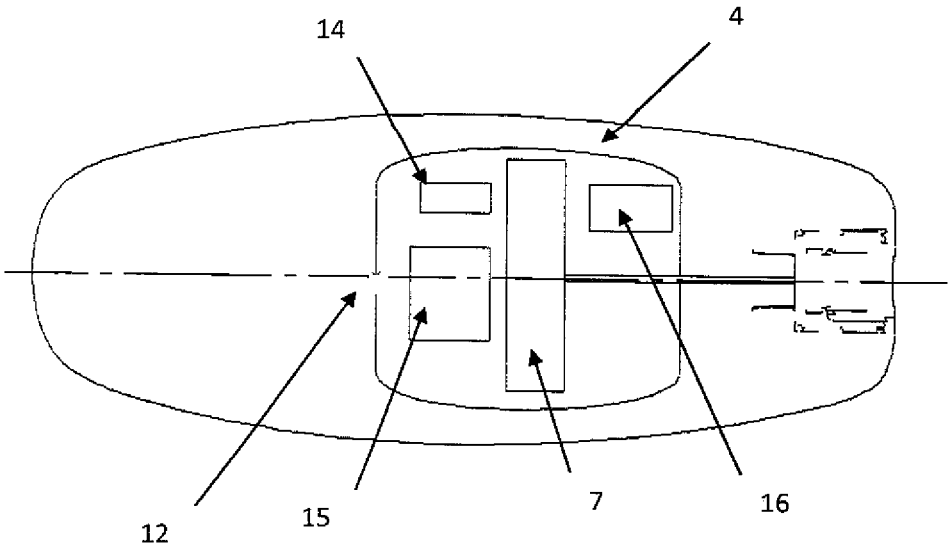

Arrangement of the engine compartment as well as its dimensions may be determined based on requirements on the inner space of the float. This minimal space is illustrated in the FIG. 6. In this minimal variant, when the engine compartment closely surrounds the engine 7, ignition 14 tank 15 and exhaust 16, a problem occurs in leading a long sealing rib and the solution is not optimal, due to leaking water a very high performance of suction pumps is required. A suitable variant is obtained by elongating the engine compartment and shortening the sealing rib 6 as illustrated in FIG. 3. In this variant, a labyrinth system is formed, which serves for water separation.

Figure 7:
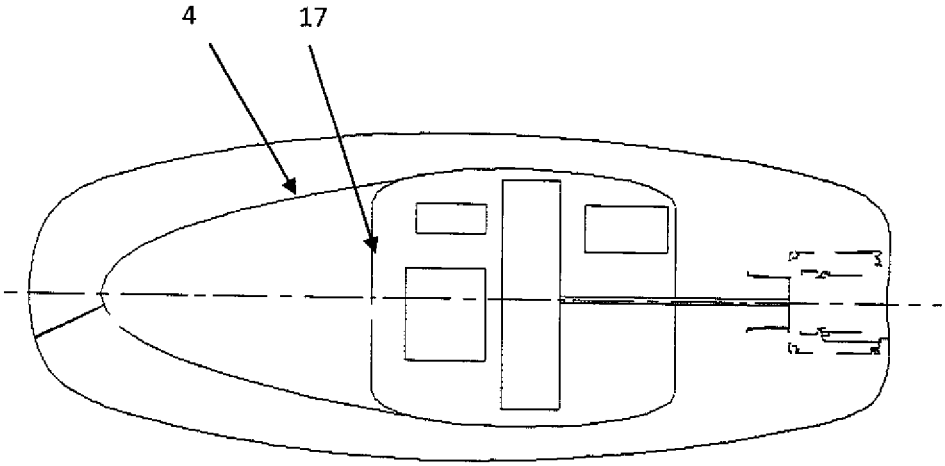
FIG. 7 illustrates an exemplary arrangement of the reinforced rib in the engine compartment, which is connected to the partition.
Figure 8:
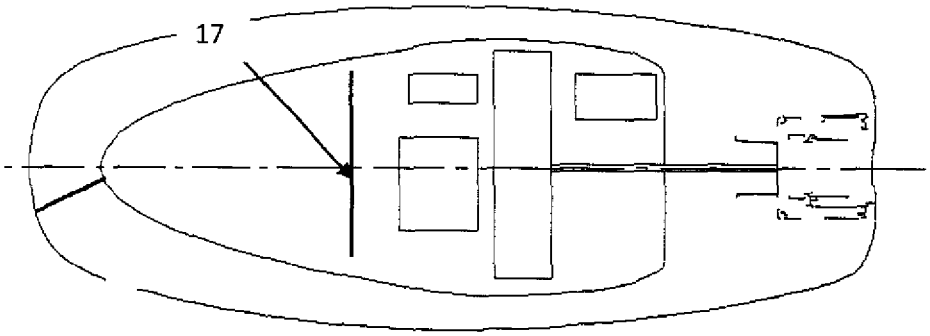
FIG. 8 illustrates an exemplary arrangement of the transverse reinforced rib in the engine compartment.
Figure 9:
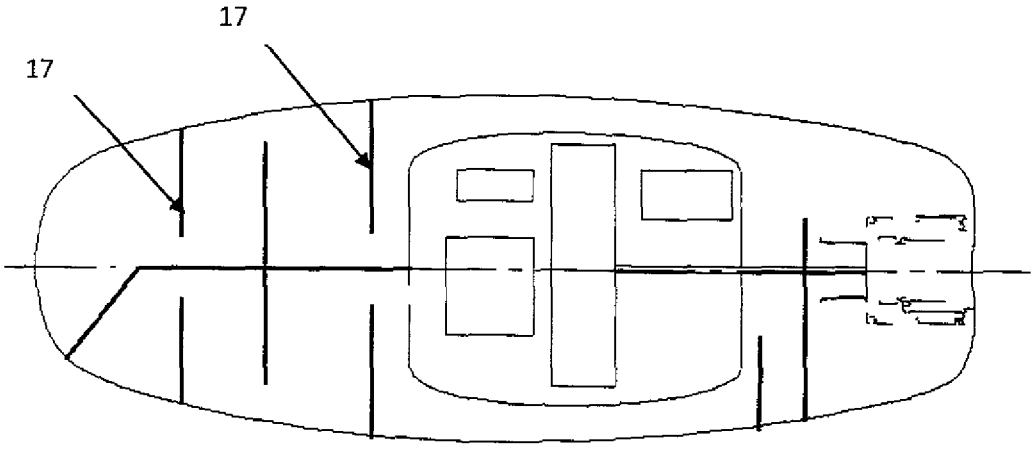
FIG. 9 illustrates an exemplary arrangement of transverse reinforced ribs outside the engine compartment, FIG. 10 an exemplary embodiment of longitudinal reinforced ribs in the engine compartment and the FIG. 11 illustrates an exemplary arrangement of the floating material in the inner space of the float.
Figure 10:
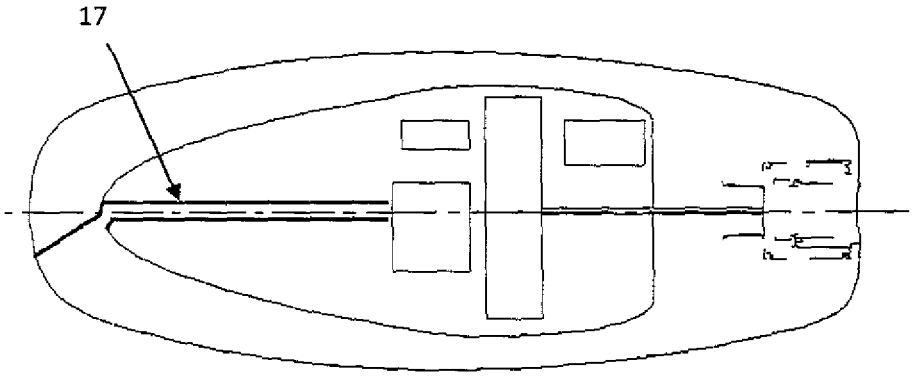

In case an excessive pressure is exerted on the float, e.g. driving in waves or jumps, it is possible to arrange a reinforcing rib 17 into the engine compartment, which is connected to the partition and provided with a suction opening, see FIG. 7. FIG. 8 illustrates an exemplary arrangement of a transverse reinforcing rib 17 in the engine compartment. FIG. 10 illustrates an exemplary arrangement of an elongated reinforcing rib 17 in the engine compartment. If necessary, it is possible to arrange several reinforcing ribs 17 which at the same time make resistance and slow down flowing water—this variant, of which the exemplary embodiment is illustrated in the FIG. 9, is suitable mainly for extreme driving conditions, such as big waves and frequent sinking. In such case, it is possible to arrange the reinforcing ribs 17 in a perpendicular direction as well as inside the engine compartment.

Figure 11:
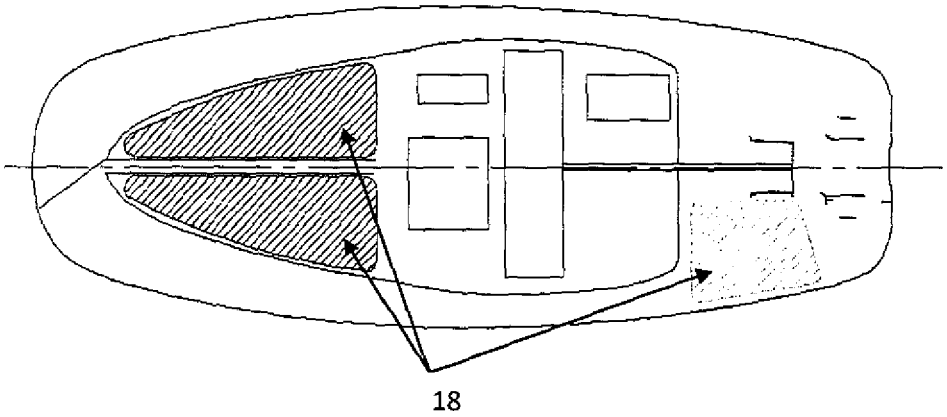

In case an unsinkable float is required, it is possible to use the embodiment illustrated in the FIG. 11 with elongated reinforcing ribs 17 when suitable shaped elements 18 made of floating material, e.g. air, foam, polystyrene, etc., are arranged into the resulting space. To provide air circulation around the elements 18 made of floating material, it is possible to use the elongated reinforcing rib 17 having a curved profile, which corresponds to the profile of the partition 4 as illustrated in the FIG. 5. In arrangement of a pair of such reinforcing ribs 17 in a mirror manner, space allowing flow of air into the engine 7 is created.

INDUSTRIAL APPLICABILITY

System for air supply to the engine of a motor float according to this invention may be used in motor floats driven by a combustion engine arranged in the inner space of the float, which are intended for one's ride over a water surface.

LIST OF REFERENCE SIGNS

1. Bottom part
2. Upper part
3. Cover
4. Partition
5. Air supply
6. Sealing rib
7. Engine
8. Carburator
9. Turbine
10. Rear pump
11. Pump
12. Suction opening
13. Driver
14. Ignition
15. Tank
16. Exhaust
17. Reinforced rib
18. Element made of floating material

The invention claimed is:

1. A system for air supply to the engine of a motor float comprising a bottom part and an upper part of the body defining the inner space of the float, in which a combustion engine is arranged, wherein the upper part of the body is in its front section provided with an air supply, wherein the combustion engine is arranged in an engine compartment, which is separated from the rest of the inner space of the float by means of a partition provided in the front part with a suction opening, wherein to secure the air circulation in the inner space of the float a sealing rib extends from the front part of the partition towards the tip of the float, separating the air supply and the suction opening from one another, wherein in the rear part of the inner space of the float at least one rear pump for sucking out the leaked water is arranged.

2. The system for air supply to the engine of a motor float according to claim 1 wherein the suction opening is arranged above the level of the bottom part of the body.

3. The system for air supply to the engine of a motor float according to claim 1 wherein the partition has a shaped profile.

4. The system for air supply to the engine of a motor float according to claim 1 further including at least one transverse or longitudinal reinforced rib arranged in the inner space of the float.

5. The system for air supply to the engine of a motor float according to claim 1 further including at least one pump arranged in the rear part of the engine compartment.

6. The system for air supply to the engine of a motor float according to claim 5, wherein a mechanical pump using underpressure generated by engine and an electric pump controlled by electronics and powered by batteries are arranged in the engine compartment.

7. The system for air supply to the engine of a motor float according to claim 1 wherein elements made of floating material are arranged in the inner space of the float.

* * * * *